US010794077B1

(12) United States Patent
Chang et al.

(10) Patent No.: US 10,794,077 B1
(45) Date of Patent: Oct. 6, 2020

(54) MECHANICAL PARKING GARAGE

(71) Applicants: Pu-Lin Chang, Tainan (TW); Chih-Feng Chang, Tainan (TW)

(72) Inventors: Pu-Lin Chang, Tainan (TW); Chih-Feng Chang, Tainan (TW)

( * ) Notice: Subject to any disclaimer, the term of this patent is extended or adjusted under 35 U.S.C. 154(b) by 0 days.

(21) Appl. No.: 16/708,682

(22) Filed: Dec. 10, 2019

(30) Foreign Application Priority Data

Aug. 22, 2019 (TW) ..... 108130043 A

(51) Int. Cl.
*E04H 6/22* (2006.01)
*E04H 6/20* (2006.01)

(52) U.S. Cl.
CPC ..... *E04H 6/22* (2013.01); *E04H 6/20* (2013.01)

(58) Field of Classification Search
CPC ..... E04H 6/20; E04H 6/22
See application file for complete search history.

(56) References Cited

U.S. PATENT DOCUMENTS 2,647,647 A * 8/1953 Alimanestiano ..... E04H 6/186 414/254
3,987,912 A * 10/1976 Leon Moyano ..... E04H 6/18 414/239
4,109,804 A * 8/1978 Leon Moyano ..... E04H 6/186 414/254
4,312,623 A * 1/1982 Allred ..... E04H 6/22 414/231
5,678,972 A * 10/1997 Bockler ..... E04H 6/18 414/234
6,328,521 B1 * 12/2001 Givati ..... E04H 6/22 414/234
8,812,148 B2 * 8/2014 Kharkover ..... E04H 6/225 700/218
9,631,390 B2 * 4/2017 Segal ..... B65G 1/06

* cited by examiner

*Primary Examiner* — Kaitlin S Joerger
(74) *Attorney, Agent, or Firm* — Muncy, Geissler, Olds & Lowe, P.C.

(57) ABSTRACT

A mechanical parking garage includes a plurality of pallets, a parking system including a rail track unit and a plurality of tower units, and a transporting system. Each tower unit is mounted on and slidable along the rail track unit, and has a plurality of first parking spaces, each of which is disposed for storing one of the pallets. The transporting system includes a rail mechanism mounted above the parking system, and a transporting mechanism mounted to the rail mechanism and being horizontally movable. Any adjacent two of the tower units are movable relative to each other between approximate state and a distal state. At the distal state, the adjacent two of the tower units define a transporting aisle therebetween.

10 Claims, 8 Drawing Sheets

MECHANICAL PARKING GARAGE

CROSS-REFERENCE TO RELATED APPLICATION

This application claims priority of Taiwanese Patent Application No. 108130043, filed on Aug. 22, 2019.

FIELD

The disclosure relates to a parking garage, and more particularly to a parking garage that uses a mechanical system to park vehicles.

BACKGROUND

A conventional mechanical parking garage includes a pallet for carrying a vehicle, a lifting unit for lifting the pallet vertically, a transporting unit for transporting the pallet horizontally, and two parking units respectively located on the left and right sides of the lifting unit. Each of the parking units includes a plurality of parking spaces arranged vertically and spaced apart from one another. To park the vehicle, a user drives the vehicle onto the pallet that is placed on the lifting unit. Then, the pallet carrying the vehicle is moved vertically next to an empty one of the parking spaces by the lifting unit, and is moved horizontally into the empty parking space by the transporting unit.

In comparison with a conventional non-multi-storey parking lot, more vehicles can be accommodated in such mechanical parking garage in the same land area. However, since the lifting and transporting units as a set cannot work with more than two parking units, if there were more parking units, more lifting and transporting units would be required as well, which will significantly increase the cost of installation and maintenance, as well as reducing the efficiency of land use.

SUMMARY

Therefore, the object of the disclosure is to provide a mechanical parking garage that can alleviate at least one of the drawbacks of the prior art.

According to the disclosure, a mechanical parking garage includes a plurality of pallets, a parking system and a transporting system. Each of the pallets is adapted for carrying a vehicle.

The parking system includes a rail track unit that is adapted to be mounted on the ground, and a plurality of tower units that are mounted on and slidable along the rail track unit. Each of the tower units has a plurality of first parking spaces, and each of the first parking spaces is disposed for storing one of the pallets.

The transporting system includes a rail mechanism that is mounted above the parking system, and a transporting mechanism that is mounted to the rail mechanism and that is horizontally movable.

Any adjacent two of the tower units are movable along the rail track unit relative to each other between a proximate state, where the adjacent two of the tower units are proximate to each other, and a distal state, where the adjacent two of the tower units are distal from each other and cooperatively define a transporting aisle therebetween.

The transporting system is operable to transport one of the pallets into one of the first parking spaces of one of the tower units via the transporting aisle between the one of the tower units and an adjacent one of the tower units.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
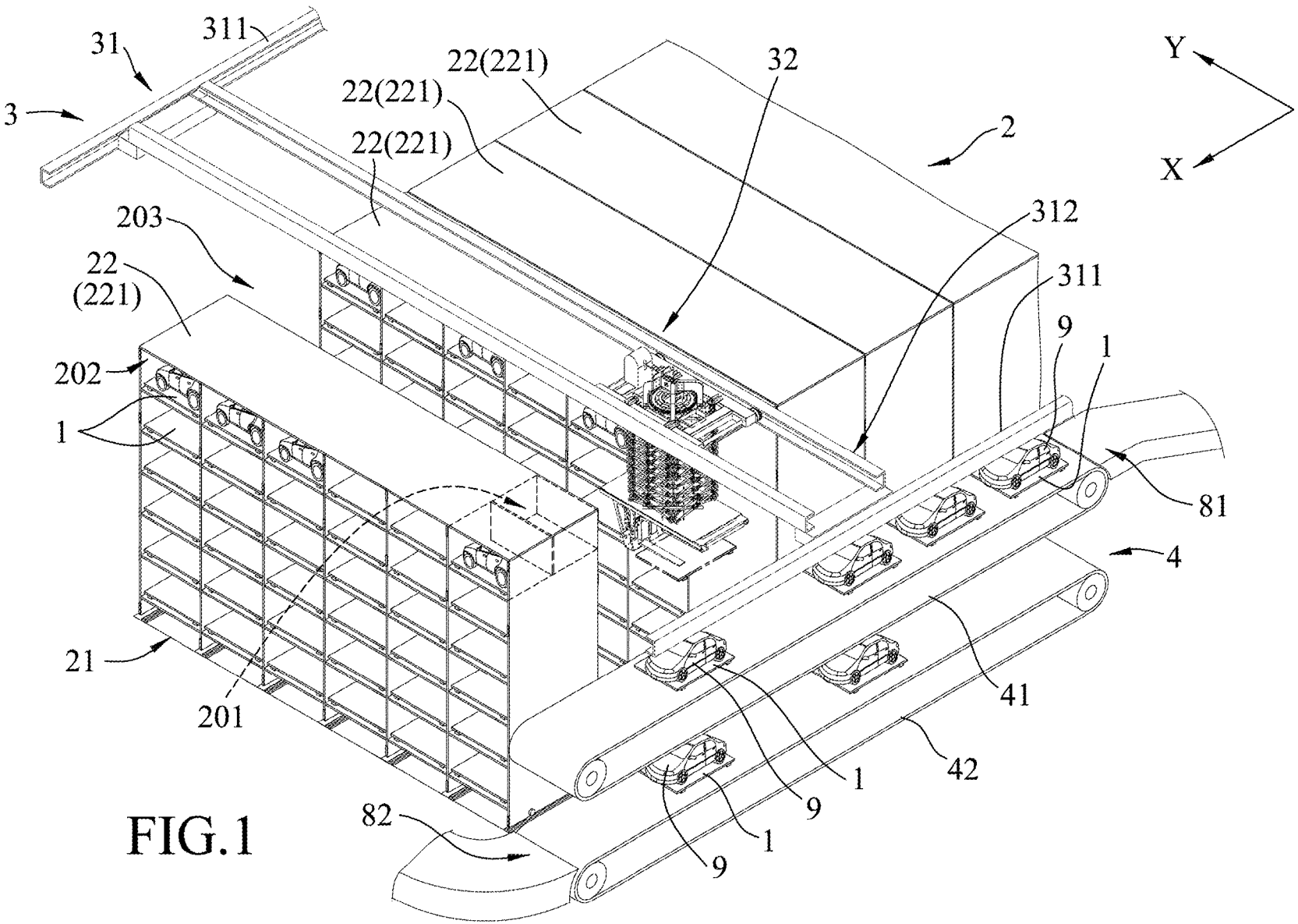
FIG. 1 is a fragmentary perspective view of a first embodiment of the mechanical parking garage according to the disclosure.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
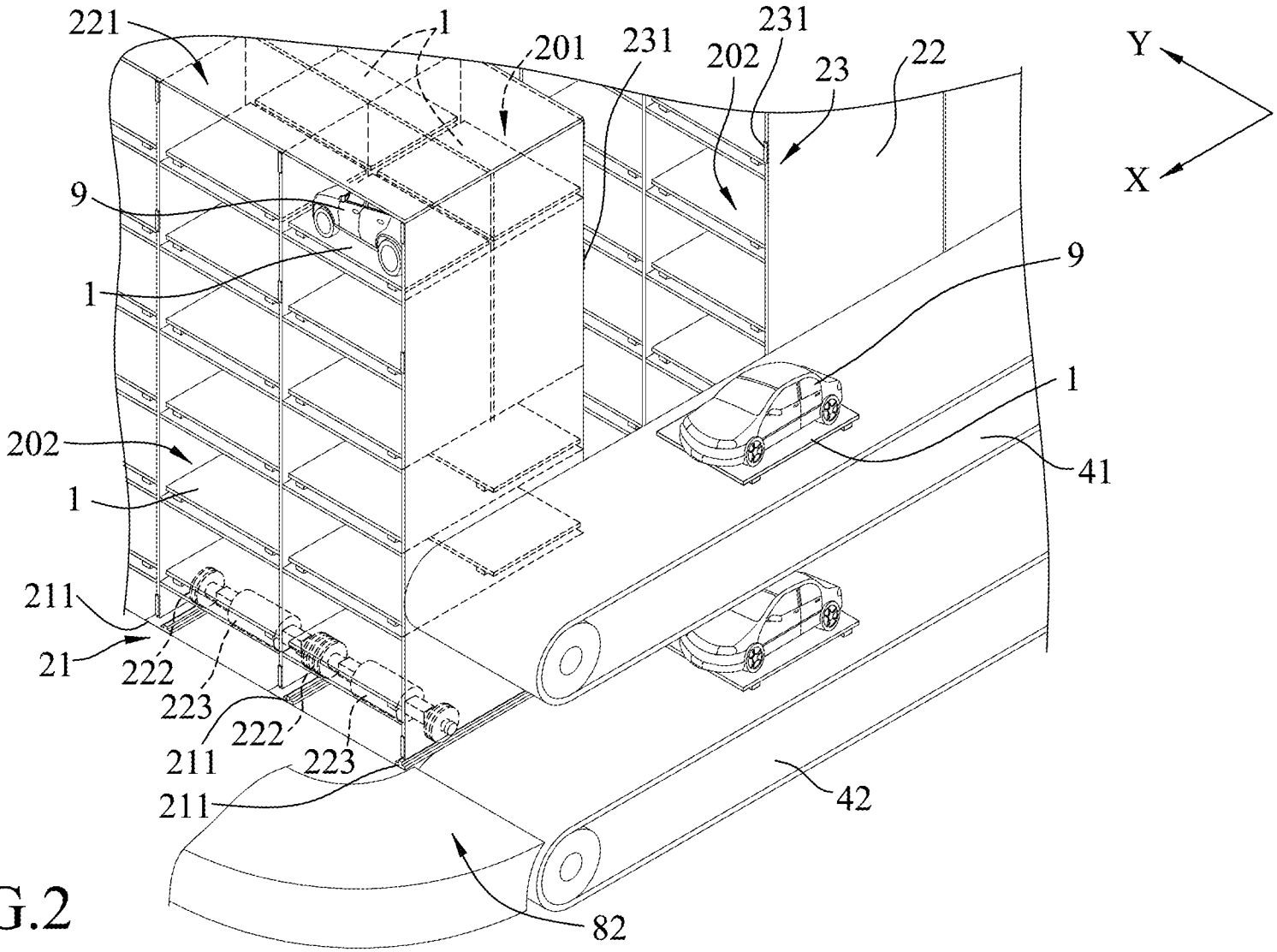
FIG. 2 is an enlarged fragmentary perspective view of the first embodiment.
Figure 4:
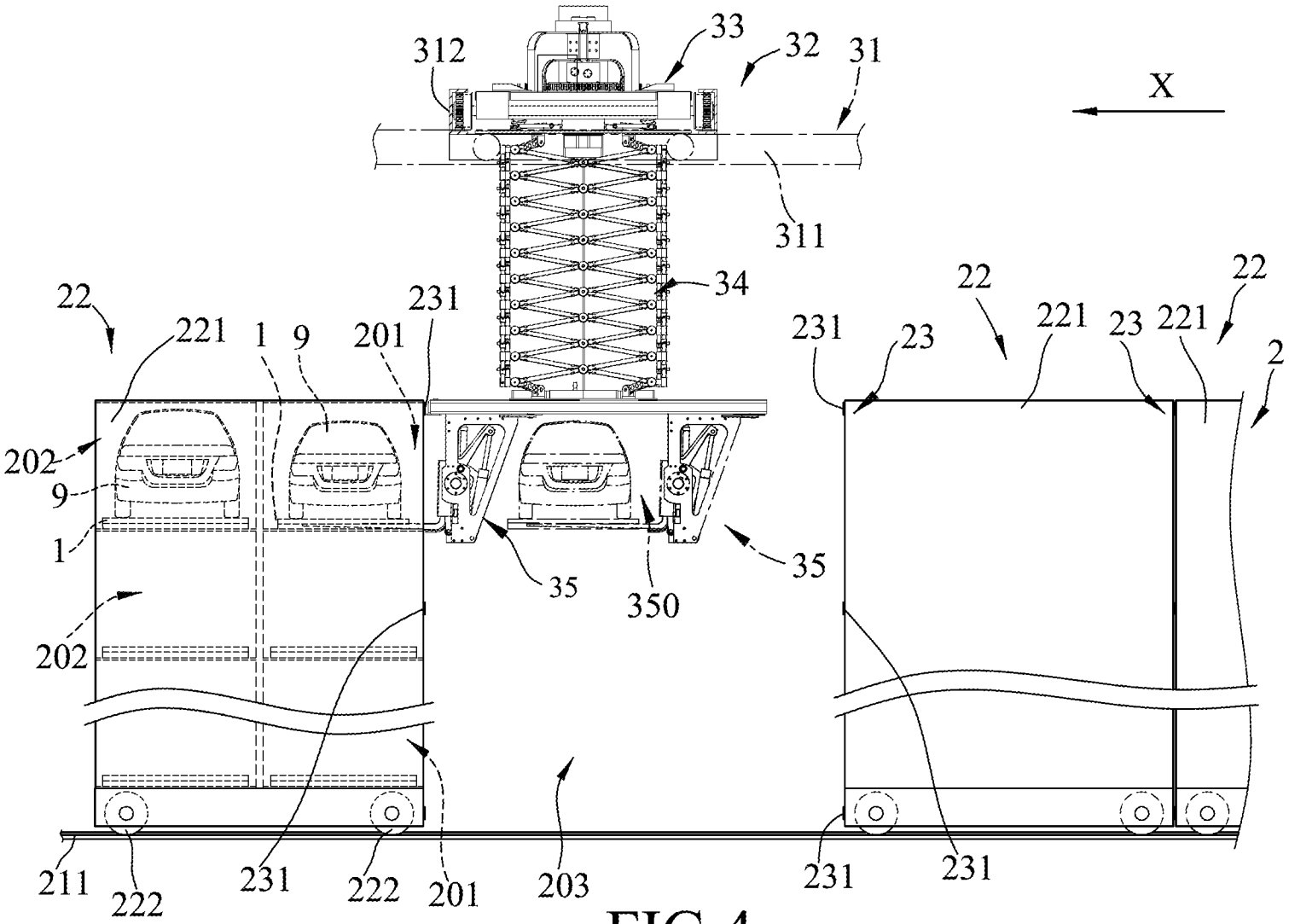
FIG. 4 is a fragmentary side view of the first embodiment.

Referring to FIGS. 1, 2 and 4, a first embodiment of a mechanical parking garage according to the disclosure has an entrance 81 and an exit 82, is adapted for accommodating a plurality of vehicles 9, and is adapted to work with parking payment equipment having a management system (not shown). Since the parking payment equipment is well known in the art and is not the focus of the disclosure, it will not be described further hereinafter.

The mechanical parking garage includes a plurality of pallets 1, a parking system 2, a transporting system 3 and a conveying system 4. Each of the pallets 1 is adapted for carrying one of the vehicles 9.

In this embodiment, the parking system 2 includes a rail track unit 21, a plurality of tower units 22 and a plurality of fixing units 23. The rail track unit 21 is adapted to be mounted on the ground, and has a plurality of rail tracks 211 that extend in a first horizontal direction (X), and that are spaced apart in a second horizontal direction (Y) which is transverse to the first horizontal direction (X).

The tower units 22 are mounted on and slidable along the rail tracks 211 of the rail track unit 21. Each of the tower units 22 includes a tower body 221, a plurality of rail wheels 222 and a plurality of driving members 223.

The tower body 221 of each of the tower units 22 has a plurality of first parking spaces 201 and a plurality of second parking spaces 202. Each of the first and second parking spaces 201, 202 is disposed for storing one of the pallets 1, and has an opening. The opening of each of the first parking spaces 201 and the opening of each of the second parking spaces 202 face outwardly and oppositely. In this embodiment, the opening of each of the second parking spaces 202 opens toward the first horizontal direction (X), and the opening of each of the first parking spaces 201 opens opposite to the first horizontal direction (X).

The rail wheels 222 of each of the tower units 22 are mounted to a bottom end of the tower body 221 and are rotatable along the rail tracks 211 of the rail track unit 21. The driving members 223 of each of the tower units 22 are mounted to the bottom end of the tower body 221, are connected to the rail wheels 222, and are operable to drive the rail wheels 222 to rotate along the rail tracks 211, thereby resulting in the sliding movement of the tower unit 22 in the first horizontal direction (X). In the present embodiment, each of the driving members 223 is an electric motor which draws electric power to drive the rotation of the rail wheels 222; however, in other embodiments of the disclosure, each of the driving members 223 may be a hydraulic motor as long as it is capable of driving the rotation of the rail wheels 222.

Any adjacent two of the tower units 22 are movable along the rail track unit 21 relative to each other between a proximate state, where the adjacent two of the tower units 22 are proximate to each other, and a distal state, where the adjacent two of the tower units 22 are distal from each other and cooperatively define a transporting aisle 203 therebetween. For example, referring specifically to the three tower units 22 in FIG. 4, the left one and the middle one of the tower units 22 are in the distal state and the transporting aisle 203 is formed therebetween. On the other hand, the middle one and the right one (only partly shown) of the tower units 22 are in the proximate state.

Each of the fixing units 23 of the parking system 2 is disposed between an adjacent two of the tower units 22, and includes a plurality of electromagnets 231 mounted to corresponding side ends of the adjacent two of the tower units 22. When the adjacent two of the tower units 22 are in the proximate state, the electromagnets 231 are electrically charged to detachably attract each other, thereby securing the adjacent two of the tower units 22 together.

The conveying system 4 includes a first conveying mechanism 41 and a second conveying mechanism 42.

The first conveying mechanism 41 extends in the first horizontal direction (X), and is connected to the entrance 81 of the mechanical parking garage. The first conveying mechanism 41 and the parking system 2 are arranged in the second horizontal direction Y) and are adjacent to each other. The second conveying mechanism 42 extends in the first horizontal direction (X), and is connected to the exit 82 of the mechanical parking garage. The second conveying mechanism 42 and the parking system 2 are arranged in the second horizontal direction (Y) and are adjacent to each other.

The first conveying mechanism 41 is operable for conveying one of the pallets 1 from the entrance 81 to the transporting aisle 203 between one of the tower units 22 and an adjacent one of the tower units 22, such that the one of the pallets 1 can be transported by the transporting system 3 (details of which will be described later) through the transporting aisle 203 into one of the first parking spaces 201 of one of the tower units 22 or into one of the second parking spaces 202 of the adjacent one of the tower units 22. In a similar manner, the second conveying mechanism 42 is operable for conveying the one of the pallets 1, which is transported by the transporting system 3 from the one of the first and second parking spaces 201, 202 to the transporting aisle 203, to the exit 82. In the present embodiment, the first and second conveying mechanisms 41, 42 are conveyor belt mechanisms but are not limited thereto.

Figure 3:
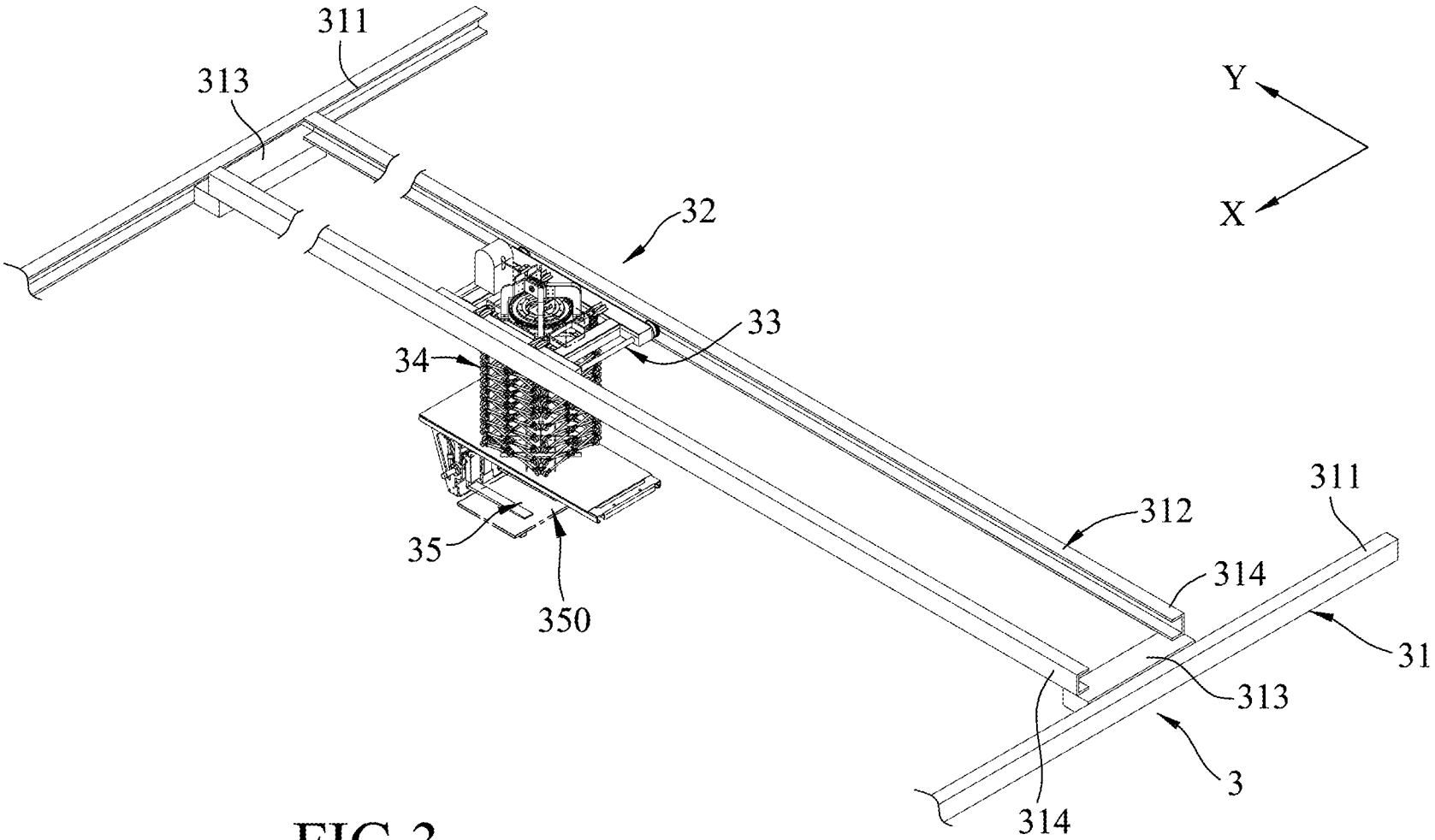
FIG. 3 is a fragmentary perspective view of a transporting system of the first embodiment.
Figure 5:
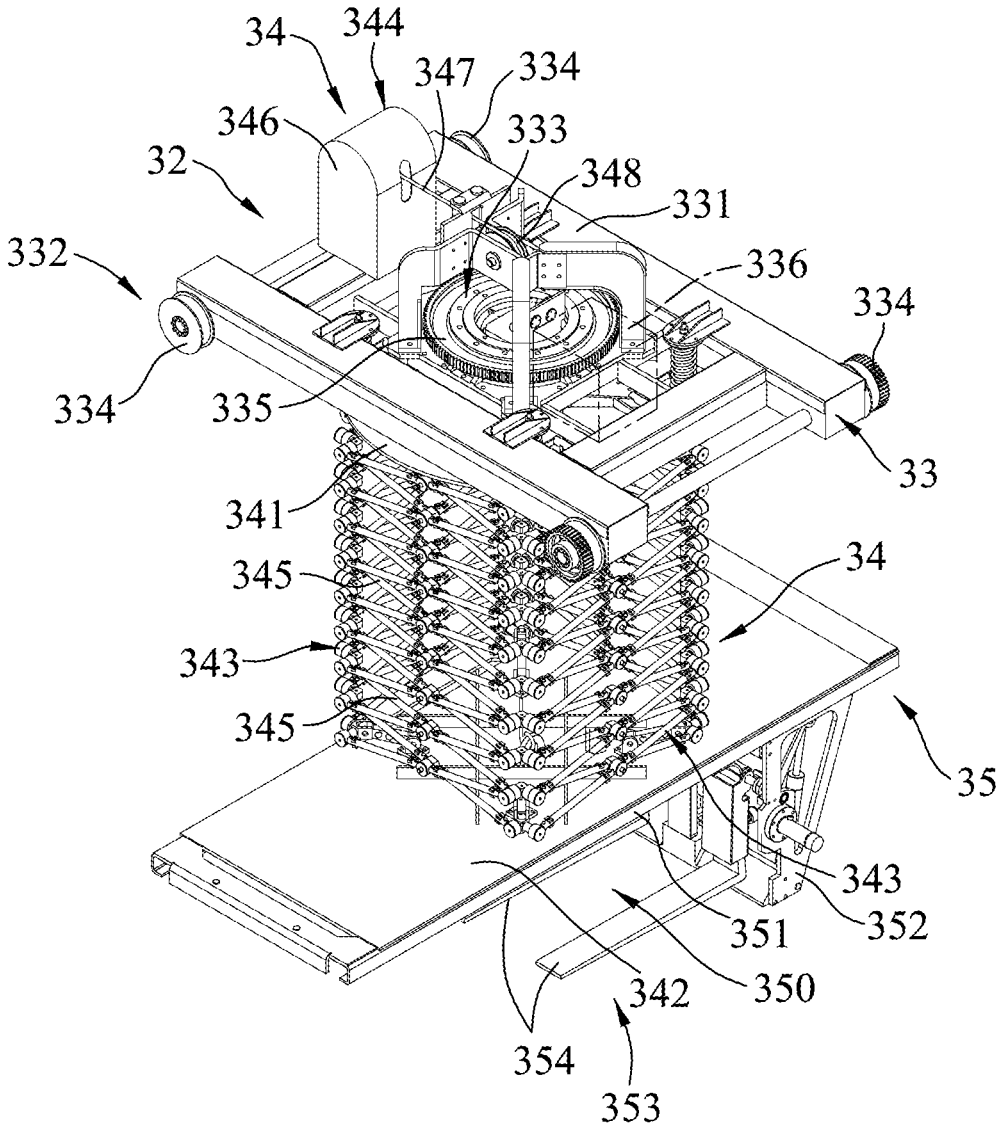
FIG. 5 is a perspective view of a transporting mechanism of the transporting system of the first embodiment.

Referring to FIGS. 1, 3 and 5, in this embodiment, the transporting system 3 includes a rail mechanism 31 and a transporting mechanism 32. The rail mechanism 31 includes two first rails 311, a second rail 312 and a plurality of slider units 313.

The first rails 311 of the rail mechanism 31 are mounted above the parking system 2, extend in the first horizontal direction (X), and are spaced apart in the second horizontal direction (Y). The second rail 312 of the rail mechanism 31 includes two rail beams 314 that extend in the second horizontal direction (Y), and that are spaced apart in the first horizontal direction (X). The slider units 313 of the rail mechanism 31 are mounted to opposite ends of each of the rail beams 314 of the second rail 321, and are mounted to and slidable along the first rails 311 such that the rail beams 314 of the second rail 312 are horizontally movable along the first rails 311.

The transporting mechanism 32 of the transporting system 3 includes a railing device 33, an elevating device 34 and a loading device 35.

The railing device 33 of the transporting mechanism 32 includes a main base 331, a railing unit 332 and a rotating unit 333. The main base 331 is movably mounted, via the railing unit 332, to the second rail 312 of the rail mechanism 31, is movable along the second rail 312, and is co-movable with the second rail 312 along the first rails 311. The rotating unit 333 is co-movably mounted to the main base 331 and is rotatable about a vertical rotational axis.

Specifically, the railing unit 332 of the railing device 33 includes a plurality of rolling wheels 334 rotatably mounted to two opposite sides of the main base 331 in the first horizontal direction (X), and a control unit (not shown) for controlling the rotation of the rolling wheels 334. It should be noted that the control unit may be a motor that is mounted to the main base 331, or a chain assembly that is mounted to the second rail 312, as long as it is capable of controlling the rotation of the rolling wheels 334.

The rotating unit 333 of the railing device 33 includes a gear disk 335 and a steering subunit 336 that is mounted to the main base 331 for driving the gear disk 335 to rotate relative to the main base 331.

Figure 6:
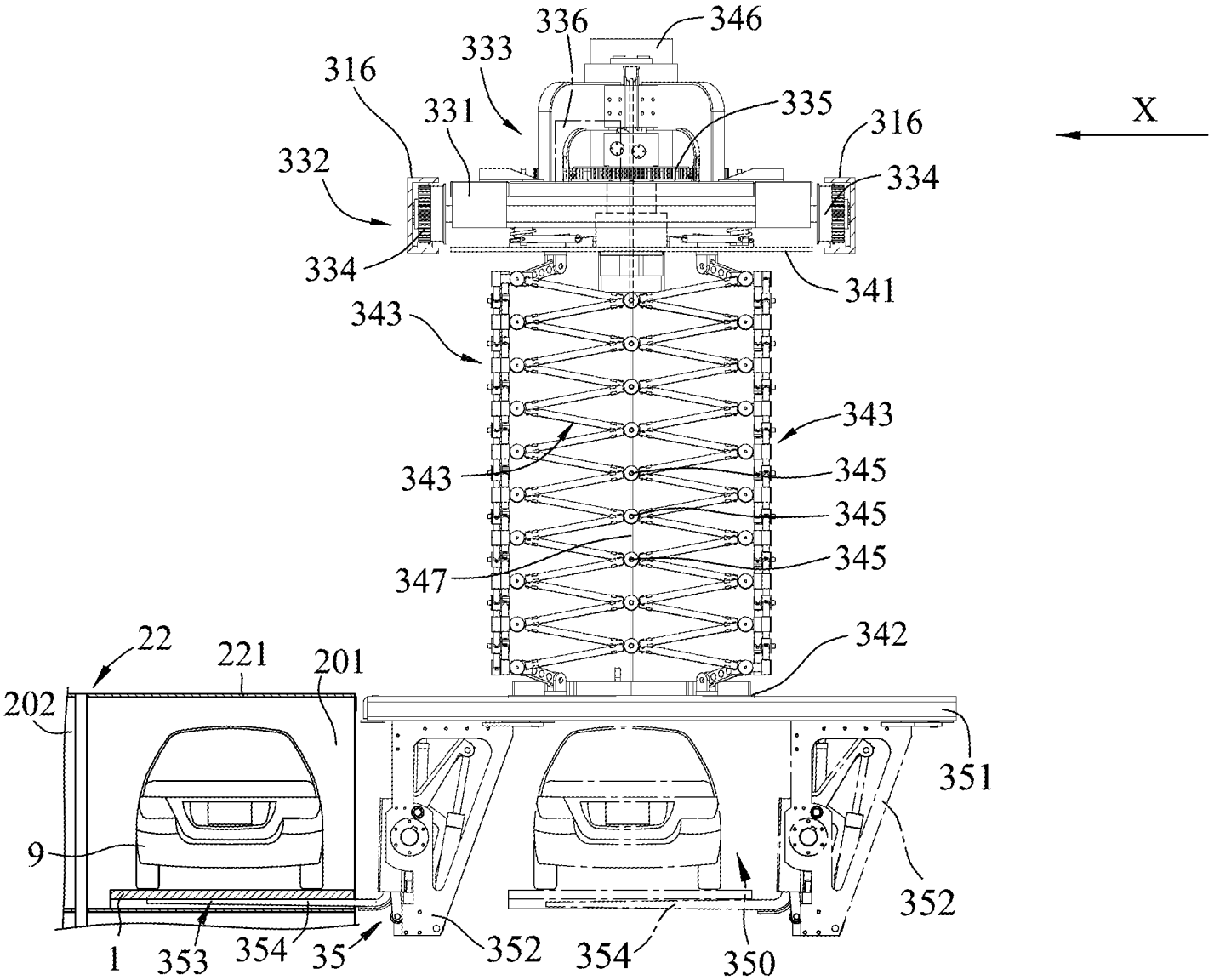
FIG. 6 is a schematic view, illustrating a loading unit of the transporting mechanism being converted from a default state to an operating state to transport a vehicle into a first parking space.

Referring further to FIG. 6, in this embodiment, the elevating device 34 of the transporting mechanism 32 includes an upper base 341, a lower base 342, four scissors units 343 (only three are visible in FIG. 6) and a hoist 344.

The upper base 341 of the elevating device 34 is disposed under and mounted to the railing device 33. Specifically, the upper base 341 is co-rotatably mounted to the gear disk 335 of the rotating unit 333 of the railing device 33 such that the steering subunit 336 of the rotating unit 333 is able to drive the gear disk 335 and the elevating device 34 to rotate together.

The lower base 342 of the elevating device 34 is connected to the loading device 35. The scissors units 343 of the elevating device 34 cooperatively form a rectangular framework connected between the upper and lower bases 341, 342, and are vertically extendable and contractible. The hoist 344 of the elevating device 34 is mounted to the railing device 33 for driving extension and contraction of the scissors units 343.

Specifically, the scissors units 343 are configured to extend or contract synchronously, so that the lower base 342 can move steadily downward or upward relative to the upper base 341. In view of the structure of the scissors units 343, each of the scissors units 343 includes a plurality of crisscross members 345 that are vertically arranged and that are pivotally connected to each other. Each of the crisscross members 345 has two pivotally-connected rods forming a scissors mechanism, and has one end connected pivotally to a respective one of the crisscross members 345 of a horizontally-adjacent one of the scissors units 343, and an opposite end connected pivotally to a respective one of the crisscross members 345 of another horizontally-adjacent one of the scissors units 343.

The hoist 344 of the elevating device 34 of the transporting system 3 includes a rope reel 346, a traction rope 347 and a guide wheel 348.

The rope reel 346 is mounted to the main base 331 of the railing device 33. The traction rope 347 is connected between the rope reel 346 and the lower base 342 of the elevating device 34. The guide wheel 348 is mounted to the main base 331 of the railing device 33 for guiding the traction rope 347, which is released from the rope reel 346, to extend through the gear disk 335 and the rectangular framework of the scissors units 343, and towards the loading device 35. In such a manner, the rope reel 346 is operable for releasing and for retracting the traction rope 347 to thereby move the lower base 342 relative to the upper base 341, resulting in the extension and contraction of the scissors units 343.

The loading device 35 of the transporting mechanism 32 includes a connecting base 351, a moving base 352 and a loading unit 353.

The connecting base 351 is disposed under and mounted co-movably to the lower base 342 of the elevating device 34. The moving base 352 is disposed under and mounted to the connecting base 351, and is horizontally movable relative to the connecting base 351.

Specifically, the connecting and moving bases 351, 352 of the loading device 35 are connected via engagement between at least one groove (not shown) that is formed in one of the connecting and moving bases 351, 352, and at least one engaging block (not shown) that is formed in the other one of the connecting and moving bases 351, 352. The moving base 352 is movable relative to the connecting base 351 via control of a hydraulic unit (not shown) connected to a bottom end of the connecting bases 351. However, details of the connecting and moving bases 351, 352 are not the focus of the disclosure, and thus are not described further hereinafter.

The loading unit 353 of the loading device 35 is co-movably mounted to the moving base 352, and includes two fork prongs 354 that are horizontally spaced apart from each other for loading and unloading one of the pallets 1. The connecting base 351, the moving base 352 and the loading unit 353 cooperatively define a loading space 350 to temporarily store one of the vehicles 9 with the one of the pallets 1.

Specifically, to load and unload the one of the pallets 1, the moving base 352 and the loading unit 353 are convertible relative to the connecting base 351 between an operating state and a default state. When the moving base 352 and the loading unit 353 are in the operating state, the fork prongs 354 protrude horizontally out of the connecting base 351. When the moving base 352 and the loading unit 353 are in the default state, the fork prongs 354 remain under and do not protrude out of the connecting base 351.

Referring to FIGS. 1, 4 and 6, a parking operation of the mechanical parking garage is exemplified by a process of transferring one of the vehicles 9 (hereinafter simplified as the vehicle 9) from the entrance 81 to one of the first parking spaces 201 of the left one of the tower units 22 shown in FIG. 4.

Before the vehicle 9 enters the mechanical parking garage, one of the pallets 1 (hereinafter simplified as the pallet 1) that was disposed in the one of the first parking spaces 201 is moved to the entrance 81 in advance. A user drives the vehicle 9 through the entrance 81 and parks the vehicle 9 on the pallet 1. Next, the user leaves the vehicle 9 and the left one of the tower unit 22 and the middle one of the tower units 22 (see FIG. 4) are driven to convert to the distal state, in which the transporting aisle 203 is formed.

Meanwhile, the first conveying mechanism 41 is operated to transfer the vehicle 9 and the pallet 1 to the transporting aisle 203, allowing another pallet 1 to be placed at the entrance 81 for loading another vehicle 9.

Then, the transporting mechanism 32 is moved to be adjacent to the pallet 1 via the rail mechanism 31, and the elevating device 34 extends downwardly such that the loading device 35 is approximately level with the pallet 1. At the same moment, the steering subunit 336 of the rotating unit 333 of the railing device 33 is operated to rotate the gear disk 335, the elevating device 34 and the loading device 35 together such that the fork prongs 354 of the loading unit 353 are steered toward the pallet 1. Next, the loading unit 353 is converted from the default state to the operating state such that the fork prongs 354 are disposed right under the pallet 1. Then, the pallet 1 and the loading unit 353 are lifted together by the elevating device 34 to be away from the first conveying mechanism 41, and the loading unit 353 is converted from the operating state back to the default state. The pallet 1 and vehicle 9 are hence temporarily stored in the loading space 350 under the elevating device 34 and can be moved with the transporting mechanism 32 to the one of the first parking spaces 201 via the transporting aisle 203.

Afterward, the steering subunit 336 of the rotating unit 333 is operated again to rotate the gear disk 335, the elevating device 34, and the loading device 35 together with the pallet 1 such that the fork prongs 354 are steered toward the opening of the one of the first parking spaces 201. During the above-mentioned process, the rectangular framework of the scissors units 343, by virtue of its sturdy structure and stable movement, is able to prevent the pallet land the vehicle 9 from shaking, thereby ensuring a smooth and steady transporting process.

Finally, the loading unit 353 is converted from the default state to the operating state such that the pallet 1 and the vehicle 9 are conveyed into the one of the first parking spaces 201, and the elevating device 34 is slightly lowered so that the pallet 1 is placed on a ground surface in the first parking space 201. Next, the loading unit 353 is converted from the operating state back to the default state, and the fork prongs 354 of the loading unit 353 are moved away from the pallet 1 to complete the parking operation of the vehicle 9. At this moment, the transporting mechanism 32 can leave the transporting aisle 203, and the left and middle ones of the tower units 22 shown in FIG. 4 can be moved from the distal state to the proximate state.

It should be noted that when two or more of the tower units 22 are in the proximate state, they are secured to each other by the fixing units 23. Compared to a height-to-depth ratio of a single one of the tower units 22, a height-to-depth ratio of multiple interconnected tower units 22 is reduced; in other words, the height-to-depth ratio decreases as the number of the tower units 22 increases. Thus, the overall structure becomes more stable and sturdy, and the tower units 22 are at lower risk of being tipped over by any external influence, such as a shock wave of an earthquake.

Figure 7:
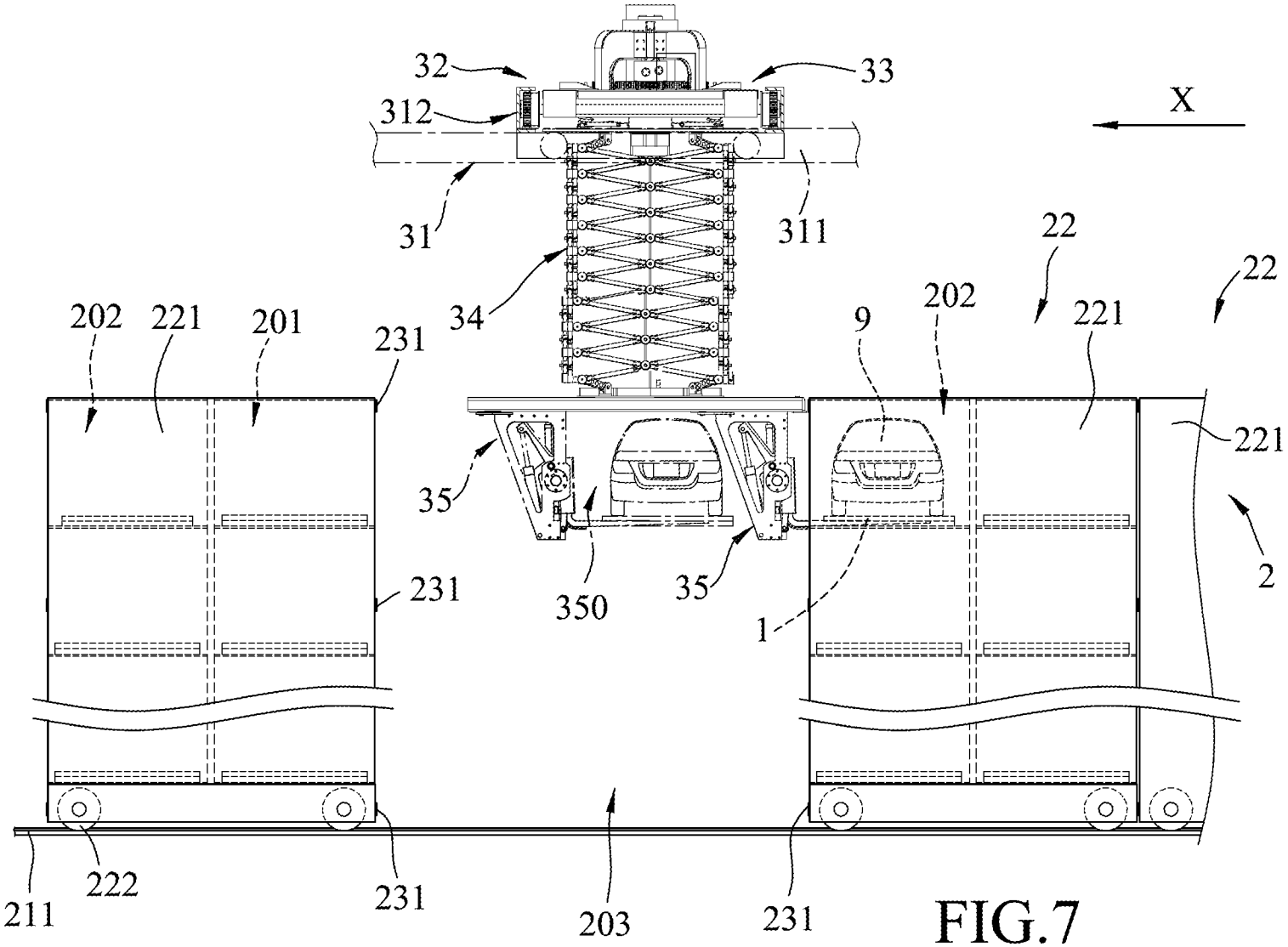
FIG. 7 is another schematic view, illustrating the loading unit transporting a vehicle into a second parking space.

Referring to FIG. 7, if the vehicle 9 is to be parked in one of the second parking spaces 202, the fork prongs 354 are steered toward the opening of the one of the second parking spaces 202, which is opposite to the opening of the one of the first parking spaces 201. The rest of the operation is the same as mentioned above, and therefore will not be described further.

When the user needs to retrieve the parked vehicle 9, the above-mentioned process is operated in reverse. However, instead of transporting the pallet 1 and the vehicle 9 back to the first conveying mechanism 41, the pallet 1 and the vehicle 9 are transported to the second conveying mechanism 42, which in turn transports the pallet 1 and the vehicle 9 to the exit 82.

It should be noted that each of the tower units 22 is not limited to having two sets of parking spaces with opposite openings (i.e. the first and second parking spaces 201, 202). In other variations of the present embodiment, each of the tower units 22 may have just one set of the first and second parking spaces 201, 202.

It should also be noted that the number of the scissors units 343 is not limited to four. In practice, the elevating device 34 may includes three or five of the scissors units 343 forming a hollow triangular or pentagonal prism as long as the structure is stable and can be extended and contracted synchronously in one direction.

Moreover, the number of the tower units 22 and the number of the first and second parking spaces 201, 202 that each of the tower units 22 has may both vary depending on actual requirements. For example, the parking system 2 may include eight tower units 22, each of which has thirty-six first parking spaces 201 and thirty-six second parking spaces 202, so that a total of five hundred seventy-six vehicles 9 can be parked. Suppose dimensions of each of the first and second parking spaces 201, 202 are approximately five-point-five meters by two meters, a total area of the parking system 2 excluding the transporting aisle 203 is approximately eighteen hundred eighty-one square meters. Adding spaces to accommodate the transporting system 3 and the conveying system 4, a total floor area of approximately thirty-three hundred and six square meters can be used for parking five hundred seventy-six vehicles 9, that is to say, each of the vehicles 9 only occupies about five-point-seven square meters of the area on average. Moreover, as a height of the mechanical parking garage increases, the average area occupied by each of the vehicles 9 decreases, thereby increasing the efficiency of land use.

Figure 8:
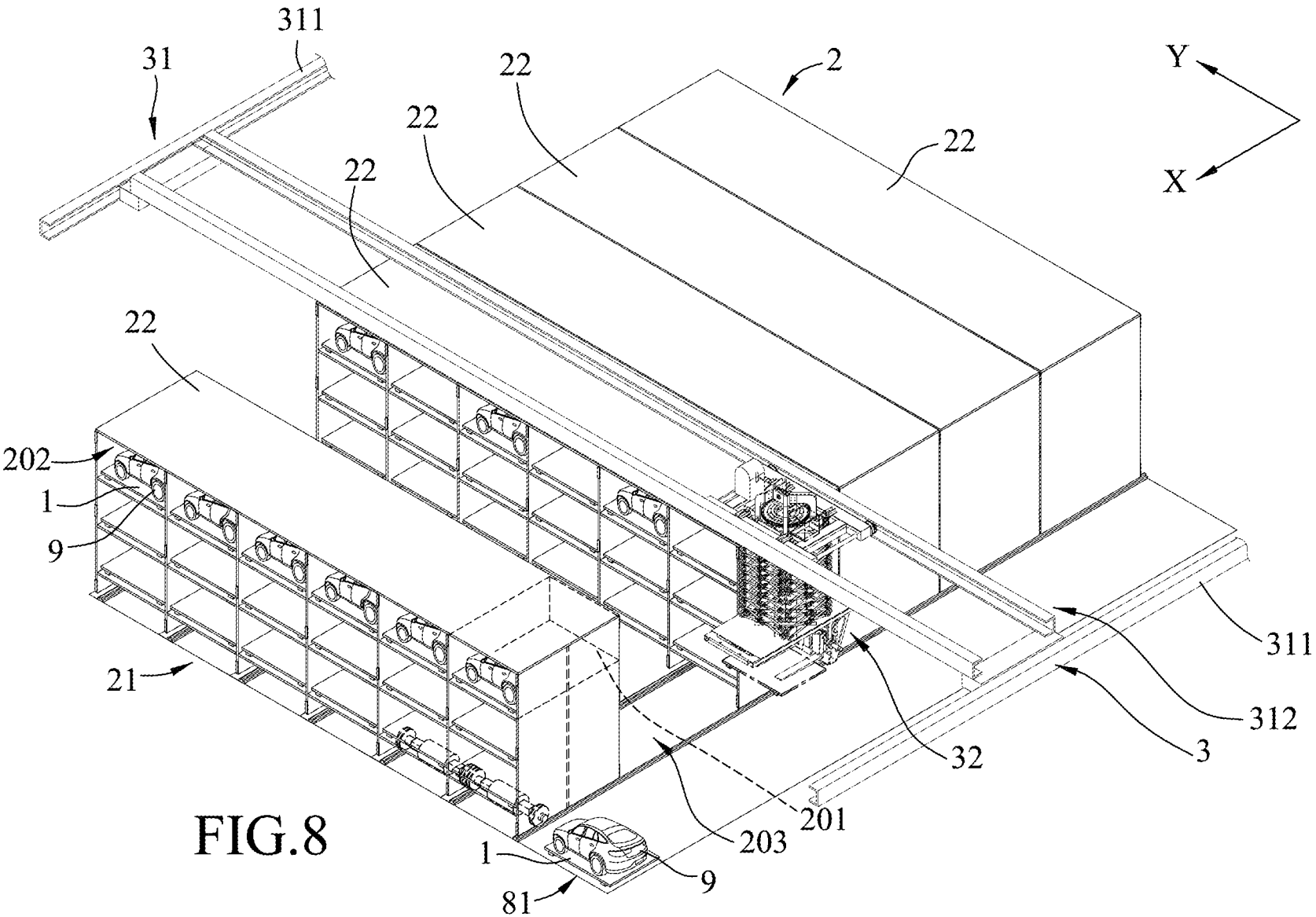
FIG. 8 is a fragmentary perspective view of a second embodiment of the mechanical parking garage according to the disclosure.

Referring to FIG. 8, a second embodiment of the mechanical parking garage according to the disclosure is similar to the first embodiment. The main difference between the two embodiments resides in that there is no conveying system 4 in the second embodiment.

Specifically, after the vehicle 9 enters the entrance 81 and is parked on the pallet 1, the transporting system 3 directly transports the vehicle 9 and the pallet 1 from the entrance 81 through the transporting aisle 203 and into, for example, the one of the first parking spaces 201. Similarly, to retrieve the vehicle 9, the transporting system 3 directly transports the vehicle 9 and the pallet 1 from the one of the first parking spaces 201 through the transporting aisle 203.

In summary, the mechanical parking garage according to the disclosure has advantages as follows.

By virtue of the tower units 22 being movable relative to each other, the transporting aisle 203 can be formed between any adjacent two of the tower units 22 at demand. Therefore, without having a permanent transporting aisle reserved between every adjacent two of the tower units 22, the efficiency of land use is greatly improved compared with the prior art.

In addition, by virtue of the rail mechanism 31 of the transporting system 3, the transporting mechanism 32 is able to move to any of the first and second parking spaces 201, 202, that is, only one transporting system 3 is needed to cover the whole mechanical parking garage, regardless of the number of the tower units 22, which is more cost-efficient compare with the prior art.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A mechanical parking garage comprising:

a plurality of pallets, each of said pallets being adapted for carrying a vehicle;

a parking system including a rail track unit that is adapted to be mounted on the ground, and a plurality of tower units that are mounted on and slidable along said rail track unit, each of said tower units having a plurality of first parking spaces, each of said first parking spaces being disposed for storing one of said pallets; and a transporting system including a rail mechanism that is mounted above said parking system, and a transporting mechanism that is mounted to said rail mechanism and that is horizontally movable;

wherein any adjacent two of said tower units are movable along said rail track unit relative to each other between a proximate state, where said adjacent two of said tower units are proximate to each other, and a distal state, where said adjacent two of said tower units are distal from each other and cooperatively define a transporting aisle therebetween; and wherein said transporting system is operable to transport one of said pallets into one of said first parking spaces of one of said tower units via said transporting aisle between said one of said tower units and an adjacent one of said tower units.

2. The mechanical parking garage as claimed in claim 1, wherein said transporting mechanism of said transporting system includes:

a railing device that includes a main base movably mounted to said rail mechanism and being horizontally movable, and a rotating unit mounted co-movably to said main base and rotatable about a vertical rotational axis;

an elevating device that is disposed under and mounted to said railing device, that is connected co-rotatably to said rotating unit of said railing device, and that is vertically extendable and contractible; and a loading device that is disposed under and mounted co-movably to said elevating device for loading and unloading each of said pallets.

3. The mechanical parking garage as claimed in claim 2, wherein said rotating unit of said railing device includes a gear disk to which said elevating device is mounted, and a steering subunit which is mounted to said main base for driving said gear disk and said elevating device to rotate together.

4. The mechanical parking garage as claimed in claim 1, wherein:

each of said tower units further has a plurality of second parking spaces, each of said second parking spaces being disposed for storing one of said pallets; and each of said first and second parking spaces has an opening, said opening of each of said first parking spaces and said opening of each of said second parking spaces facing outwardly and oppositely.

5. The mechanical parking garage as claimed in claim 1, wherein said rail mechanism of said transporting system includes:

two first rails mounted above said parking system, extending in a first horizontal direction, and being spaced apart in a second horizontal direction which is transverse to the first horizontal direction; and at least one second rail extending in the second horizontal direction, mounted to said first rails, and being movable along said first rails, said transporting mechanism of said transporting system being mounted to said at least one second rail, being movable along said at least one second rail, and being co-movable with said at least one second rail along said first rails.

6. The mechanical parking garage as claimed in claim 1, wherein said parking system further includes at least one fixing unit that is disposed between an adjacent two of said tower units, and that includes a plurality of electromagnets mounted to corresponding side ends of said adjacent two of said tower units and detachably attracting each other to secure said adjacent two of said tower units together when said adjacent two of said tower units are in the proximate state.

7. The mechanical parking garage as claimed in claim 2, wherein said elevating device of said transporting system includes:

an upper base connected to said railing device of said transporting system;

a lower base connected to said loading device of said transporting system;

at least one scissors unit connected between said upper and lower bases and vertically extendable and contractible; and a hoist mounted to said railing device for driving extension and contraction of said at least one scissors unit.

8. The mechanical parking garage as claimed in claim 7, wherein said hoist of said elevating device of said transporting system includes:

a rope reel that is mounted to said railing device of said transporting system;

a traction rope that is connected between said rope reel and said lower base of said elevating device; and a guide wheel that is mounted to said railing device for guiding said traction rope released from said rope reel towards said loading device, said rope reel being operable to release and to retract said traction rope to thereby move said lower base relative to said upper base to result in the extension and contraction of said at least one scissors unit.

9. The mechanical parking garage as claimed in claim 2, wherein said loading device of said transporting mechanism of said transporting system includes:

a connecting base disposed under and mounted to said elevating device of said transporting mechanism;

a moving base disposed under and mounted to said connecting base, and being horizontally movable relative to said connecting base; and a loading unit co-movably mounted to said moving base for loading and unloading each of said pallets.

10. The mechanical parking garage as claimed in claim 1, further comprising a conveying system including:

a first conveying mechanism that is connected to an entrance of said mechanical parking garage, and that is operable for conveying said one of said pallets to said transporting aisle between said one of said tower units and said adjacent one of said tower units to be transported by said transporting system into said one of said first parking spaces of said one of said tower units; and a second conveying mechanism that is connected to an exit of said mechanical parking garage, and that is operable for conveying said one of said pallets, which is transported by said transporting system from said one of said first parking spaces to said transporting aisle, to said exit.

* * * * *